United States Patent [19]

Schomakers

[11] 4,391,604

[45] Jul. 5, 1983

[54] PROCESS FOR DYEING TEXTILE FABRIC: MECHANICAL TREATMENT TO PROMOTE FOAMING IN FABRIC BEFORE STEAMING

[76] Inventor: Hans Schomakers, An den Gassenwiesen 4, 6415 Petersberg, Fed. Rep. of Germany

[21] Appl. No.: 313,353

[22] Filed: Oct. 20, 1981

[30] Foreign Application Priority Data

Oct. 21, 1980 [DE] Fed. Rep. of Germany ..... 3039661

[51] Int. Cl.[3] ..... D06B 1/08

[52] U.S. Cl. ..... 8/477; 8/149.3; 8/929

[58] Field of Search ..... 8/477, 929, 149.3

[56] References Cited

U.S. PATENT DOCUMENTS

| | | | |
|---|---|---|---|
| Re. 29,251 | 6/1977 | Appenzeller et al. | 68/22 R |
| 3,271,102 | 9/1966 | Morsan | 8/151 |
| 4,010,709 | 3/1977 | Sayman et al. | 68/205 R |
| 4,141,231 | 2/1979 | Kudlich | 68/205 R |

FOREIGN PATENT DOCUMENTS 2057049 6/1972 Fed. Rep. of Germany .

*Primary Examiner*—A. Lionel Clingman

*Attorney, Agent, or Firm*—Schwartz, Jeffery, Schwaab, Mack, Blumenthal & Koch

[57] ABSTRACT

The dyeing of textile fabrics conventionally calls for the wetting of fabric pile with a dye solution. Difficulties arise in achieving uniform wetting and consequently uniform dyeing of the textile fabric without expenditure of large amounts of energy or dyeing solution. The present invention solves the problem of uniform dyeing according to a process wherein the textile fabric is wetted with an unfoamed dyeing solution containing a foaming agent, followed by mechanical treatment by means of alternating compression and relief and finally, a steam treatment process.

10 Claims, No Drawings

PROCESS FOR DYEING TEXTILE FABRIC: MECHANICAL TREATMENT TO PROMOTE FOAMING IN FABRIC BEFORE STEAMING

BACKGROUND OF THE INVENTION

1. Field of the Invention

The invention concerns a process for the dyeing of non-woven textile fabrics. More particularly, the invention relates to the dyeing of tufted pile fabrics by a process including placement of the non-woven fabric into a dye solution mixed with foaming chemicals followed by treatment with saturated steam.

2. Background of the Art

In the dyeing of textile pile fabric, particularly tufted carpets, it is of decisive importance to obtain a uniform wetting of the pile and to maintain a uniformity of wetting during the entire dyeing process. Without uniform wetting, uniform dyeing of the fabric cannot be assured. An inadequate penetration of the dyeing solution in depth in the fabric leaves the pile without exposure to the dye in its base area, while possibly overdyeing the peak areas. On the other hand, the introduction of an insufficient amount of the dye particularly in the steam phase will result in the bleaching of peaks.

In the known dyeing processes for the abovedescribed reasons, the non-woven textile fabric is soaked to saturation with the dyeing solution. The amount of dyeing solution necessary for saturation depends on the structure of the pile fabric itself with an amount of the dyeing solution being at least 300% to 700% with respect to the weight of the dry material to be dyed. After saturation with the dyeing solution, the fabric is filled and thereafter immediately placed in the steaming apparatus. The boiling bubbles generated during the treatment with saturated steam (and supported by the foaming agents contained in the dyeing solution) cause the solution to foam and thus to penetrate the fabric. This generally results in a uniform dyeing of the pile over its entire height. The results of dyeing with this process are generally satisfactory, but the necessary quantity of the dyeing solution amounting to several times the weight of the fabric to be dyed is considered to be disadvantageous because it requires the consumption of extraordinarily high quantities of energy for both the heating to a boiling temperature and the subsequent drying of the pile fabric. Furthermore, in spite of the use of large amounts of the dyeing solution, quality defects, especially in the form of longitudinal streaking, cannot be completely prevented.

To reduce the high energy requirements of the described saturation-steaming process, the so-called form dyeing process has come into use more recently. According to the foam dyeing process, the dyeing solution is mixed with foaming agents and prefoamed by means of mechanical stirring. The foam product in this manner is applied to the material to be dyed in a layer thickness of 10–20 mm and suctioned into the pile fabric by the application of suction to the backside of the fabric. The pile fabric is then exposed in the usual manner to a treatment with steam. According to this known process, the amount of the dyeing solution necessary may be reduced to 200%, with a corresponding reduction in the energy required for the subsequent steaming and drying process. However, the problems arising from the maintenance of a uniform color quality are thereby enhanced. It has been found that the quality of the color depends decisively on the degree of foaming of the dyeing solution, i.e., on the ratio of liquid to air in the foam. The maintenance of a narrow ratio of liquid to air is necessary but difficult. This ratio within the narrow range cannot be insured over extended periods of time. The use of this process, therefore, constantly results in inadequate dye-through or in dark areas because of overdyeing. Problems arise from the fact that the foam particles are not suctioned into the fabric, and they break down during the steaming process only where they cause excessive pigmentation of the pile fabric in the peak areas.

SUMMARY OF THE INVENTION AND DESCRIPTION OF THE PREFERRED EMBODIMENTS

An object of the present invention, therefore, is to provide a dyeing process whereby the uniform and cost effective dyeing of textile fabrics, particularly tufted pile fabrics and non-woven fabrics, may be effected. Continuous dyeing is made possible according to this invention. The invention comprises wetting the fabric with an unfoamed dyeing solution containing foaming agents, exposing the fabric wetted to a mechanical treatment by means of alternating compression and relief, and then subjecting the fabric to a steaming process.

It has been found that during a mechanical treatment according to the instant invention of a fabric previously wetted with a liquid dyeing solution, the air suctioned in during each relief of pressure causes the foaming of the dyeing solution from the inside out. In this manner a uniform distribution of dye is made possible even with the lowest possible degree of wetting. Furthermore, improved penetration of dye into the filaments is achieved. Thus, the uniform and complete dyeing of the pile is assured. When operating according to this invention, the application of the dyeing solution in amounts of 50 to 150% of the dry weight of the fabric to be dyed is sufficient. Thus, the present invention permits a further reduction in the amount of dye solution to be used without loss of dyeing quality. A reduction of one third of the amount of dye considered optimum in the prior art foam-dyeing process is made possible. An absolutely uniform dyeing quality is achieved by the foaming which occurs "internally" according to the instant invention. By internally is meant that foaming occurs at the innermost areas of the fabric pile first, then progresses to the outer fabric pile, whilst according to the processes known in the art the foam in a first step is produced outside of the pile an then in a second step applied to the pile and mechanically worked in.

The mechanical treatment of alternating compression and relief may be effected in any manner desired. For example, rolling or milling in one or several stages is suitable. In a preferred embodiment, the textile fabric is advantageously prewashed prior to the application of the dyeing solution and subsequently suctioned off to remove the excess liquid. The penetration of the dyeing solution during foaming is thereby facilitated by the opening of the filaments.

The foaming agents may be any of those foaming agents well known in the so-called prior art foam-dyeing process or any chemical agent compatible with the dyeing solution and capable of causing foaming of the solution upon variations in pressure in the environment of the solution.

The dyeing solution may be any of the well known dyeing solutions utilized in the pile-fabric-dyeing art.

Suitable apparatus for conducting the various steps of the instant process and descriptions of conventional dyeing solutions and foaming agents and the like are found in U.S. Pat. No. 3, 271,102 and German Offenlegungsschriften Nos. 1 937 100, 1 958 907, 2 057 049, 2 229 791 and German Auslegeschrift No. 1 760 657, the disclosures of which are incorporated herein.

What is claimed is:

1. A process of dyeing textile fabrics comprising:

(a) wetting a fabric with an unfoamed dyeing solution containing foaming agents;

(b) exposing the wetted fabric to a mechanical treatment consisting of alternating compression and relief; and (c) subjecting the wetted, mechanically treated fabric to a steaming treatment.

2. The process of claim 1 wherein said fabric is a continuous fabric and steps (a), (b) and (c) are conducted continuously.

3. The process of claim 1 or 2 wherein said fabric is wetted with said dyeing solution in an amount of about 50% to about 150% with respect to the dry weight of the fabric to be dyed.

4. The process of claim 3 wherein said mechanical treatment consists of alternating compression and relief brought about by passing the fabric over at least one set of compression rollers.

5. The process of claim 3 wherein said mechanical treatment consists of alternating compression and relief brought about by passing the fabric through a mill operation.

6. The process of claim 1 or 2 further comprising prewashing said fabric prior to wetting said fabric with the dyeing solution.

7. The process of claim 6 further comprising removal of moisture from said prewashed fabric by suction prior to wetting said fabric with the dyeing solution.

8. The process of claim 1 or 2 wherein said fabric is a non-woven fabric.

9. The process of claim 8 wherein said non-woven fabric is a pile fabric.

10. The process of claim 8 wherein said fabric is a tufted pile fabric.

* * * * *